United States Patent [19]

Meinig

[11] Patent Number: 4,558,582

[45] Date of Patent: Dec. 17, 1985

[54] APPARATUS FOR FLANGING VENTILATION DUCT WALLS

[76] Inventor: Manfred Meinig, Seitinger Str. 186, 7201 Weilheim, Fed. Rep. of Germany

[21] Appl. No.: 539,989

[22] Filed: Oct. 7, 1983

[30] Foreign Application Priority Data

Oct. 13, 1982 [DE] Fed. Rep. of Germany ..... 3237928

[51] Int. Cl.[4] ..... B21D 5/02

[52] U.S. Cl. ..... 72/381; 72/387; 72/384; 72/306; 72/319; 72/456

[58] Field of Search ..... 72/381, 386, 387, 383, 72/384, 306, 403, 319, 456

[56] References Cited

U.S. PATENT DOCUMENTS

| | | | |
|---|---|---|---|
| 3,245,245 | 4/1966 | Gordon | 72/306 |
| 3,468,155 | 9/1969 | Ross | 72/456 |
| 3,659,985 | 5/1972 | Marshall et al. | 72/453.01 |
| 4,434,644 | 3/1984 | Gargrave et al. | 72/387 |

FOREIGN PATENT DOCUMENTS 1402838 10/1968 Fed. Rep. of Germany .

*Primary Examiner*—Daniel C. Crane
*Assistant Examiner*—David B. Jones
*Attorney, Agent, or Firm*—Leonard Bloom

[57] ABSTRACT

An apparatus is provided which forms flanges on sheet metal for ventilation duct walling. The apparatus comprises a die support which contains a pressure die, a beam punch carrier mounted in low-friction manner on the die support, and a forming roller pivotally housed in a recess of the die support. Hydraulic drives are supported, each between the die support on the one hand and the beam punch carrier or the forming roller on the other hand, and these produce the movements necessary for edge folding and roll forming. The forces which arise are taken up directly at their point of origin by the mutually moving parts themselves.

22 Claims, 5 Drawing Figures

APPARATUS FOR FLANGING VENTILATION DUCT WALLS

BACKGROUND OF THE INVENTION

The invention relates to an apparatus for flanging ventilation duct walls from sheet metal by successive edge folding and roll forming, with at least three parts mutually displaceable by hydraulic drive, of which a first part is designed as a forming roller.

An apparatus of this kind is known from DE-OS No. 1 402 838 (German laid-open Specification). This known apparatus is very complicated and expensive both in its manufacture and in servicing and maintaining it. A large part of the mechanical expense is caused by the fact that, as is quite general in the present state of the art, the substantial forces which arise in edge folding and roll forming are transmitted to a machine frame firmly anchored to the ground, so that all parts of the apparatus must be designed very heavy and large. In order to achieve the necessary rigidity, large and heavy forming rollers and beam punches must be used, since all the forces must be transmitted outwardly to the machine frame. In complicated shaping work these large forming rollers and beam punches get in the way, so that the workpieces cannot be placed in certain positions which might be otherwise desirable.

It is further necessary to have mounting and guides which are stable, large and expensive to maintain, for transmitting the large forces which arise. Finally, the machine frame or the lateral support stands must be very stable in order to absorb the forces.

In particular, however, working with the known apparatus is relatively costly, for the reason that the workpieces, which are for the most part very bulky, have to be turned after almost every pressing or bending operation. This necessitates heavy manual work. These problems become even more severe, when flanges are to be formed directly on duct walls of several meters length, since repositioning of these workpieces in the machine would be particularly expensive.

The invention aims to provide an apparatus which, by absorbing in its interior the forces which arise, permits a substantially smaller and lighter construction of said apparatus, and allows flanges with multiple folds to be formed directly onto ventilation duct walls of sheet metal in a single working step without respositioning the workpeice.

This problem is solved in accordance with the invention, by designing the second part of the apparatus as a die support containing a pressure die, and the third part as a beam punch carrier containing a beam punch which can be pressed against the pressure die, by mounting the die support and the beam punch carrier for low-friction mutual horizontal displacement, by supporting a first hydraulic drive between the die support and the beam punch carrier, by mounting the forming roller pivotably in the die support, and by supporting a second hydraulic drive between the die support and the forming roller.

The apparatus according to the invention is of substantially smaller dimensions and has simpler component parts than all known apparatuses, since all the forces which arise are absorbed immediately at their point of origin and the reaction forces thereto are applied within the apparatus at the shortest possible distance therefrom. Thus the material cost of this apparatus can be reduced to about 20%, and the finishing cost to about 30% of those costs of the known apparatuses.

Machine frames and lateral support stands can be dispensed with completely. All movements of the machine parts are effected by a very simple hydraulic installation, which for preference can consist of only two pairs of cylinders. All turning, repositioning or multiple insertion of the workpiece is done away with. The workpiece is inserted once into the apparatus, and can be removed from it afterwards with the flange ready formed thereon. As a result of the very small dimensions of the apparatus even complicated, angled duct walls can be worked, since no outlying machine parts stand in the way of such workpieces. The entire apparatus consists substantially of only three simply manufactured and easily replaced component parts. Maintenance is simplified as a result; friction arising between the individual machine parts is insignificant. Lubrication is only necessary for the movement of the forming roller in the die support. The beam punch can be manufactured relatively easily by casting in steel. The pressure die can be machined (milled) into the die support. All in all, therefore, the above mentioned simple manufacture, service and maintenance is achieved.

In an advantageous embodiment the beam punch carrier is mounted for horizontal displacement on rollers which are provided in the die support; this serves to further reduce friction between the parts of the apparatus. The hydraulic drive accordingly has practically no frictional forces to overcome.

In order to arrange the roll forming, which follows after the edge folding, in a particularly simple manner, the pressure die, in a further advantageous embodiment of the invention, is partly formed from the forming roller. Thus as soon as the edge folding has finished and the beam punch has been withdrawn the forming roller can bend that part of the workpiece which abuts it into the desired final flange shape. For this there are necessary a total of only two simple maneuver of the apparatus, on the one hand a linear movement of the beam punch towards the die support and back again, and on the other hand a swivelling movement of the forming roller and its reverse. The hydraulic apparatus necessary for this purpose is quite simple, as will be appreciated.

In a prefered embodiment for forming on a duct wall, a flange of approximately triangular cross section, the die support forms two sides of the pressure die which is of substantially rectangular cross section, and the forming roller forms the third side of the pressure die. Thus that side of the pressure die which is formed by the forming roller can have an outwardly directed bevel, which agrees with a corresponding bevel on the beam punch. In this way the finished flange can receive a fixing strip parallel to the non-deformed duct walling.

In order to obtain the most stable and energy-sparing mounting of the forming roller in the die support, a further advantageous embodiment of the invention provides that the forming roller is mounted on a bearing surface of the die support by means of a sliding surface of its own, adapted to said bearing surface, for pivotal movement about the mid-axis of the bearing surface, the latter having an arcuate cross section. In this arrangement the mid-axis of the bearing surface approximately coincides, for preference, with an edge of the pressure die. It is desirable that that edge of the beam punch which cooperates with the one edge of the pressure die is bevelled.

There is thus achieved a more useful development of the workpiece sheet metal in view of the desired profile shape, for the following roll forming procedure.

Because of the large contact surface of the forming roller in the bearing surface of the die support, there is a relatively insignificant surface pressure, with consequent advantages for the working life of the apparatus.

In a preferred embodiment, the bearing surface is formed from a pipe section of bronze, the cross section of which corresponds to an arc of a circle. This pipe section is anchored in the die support, in an advantageous embodiment, by pouring a charge of casting resin into a space between the bronze pipe section and the recess of the die support. In this way there is achieved a sufficiently stable and resistant anchorage.

In order to achieve the simplest possible method of working with the apparatus according to the invention, the forming roller possesses a groove for receiving the vertically disposed duct wall before the edge folding. This groove, in the corresponding pivotal attitude of the forming roller, i.e. before the roll forming, is flush with the vertical outer surface of that section of the die support which borders on the side of the pressure die lying opposite the forming roller, said vertical outer surface being directed towards the beam punch. Thus, if a duct wall is placed vertically in this stop groove of the forming roller, and allowed to lean against the outer side of the die support, it takes up a position of 90° angular displacement on the upper side of the beam punch, with the exception of the flange region which is to be formed, and is supported thereafter by the beam punch. This procedure is of particular advantage, because no special guiding elements are needed for swivelling the duct wall from the vertical position into the horizontal position. This swivelling takes place by gravity alone, on the basis of the advance of the beam punch into the pressure die and the associated traction of the end of the duct wall into the pressure die. Every movement of the duct walling in another direction than from the vertical downward into the horizontal position would demand complicated guide means. Neither is there any danger, with this movement, that the flange region would become bent with respect to the remainder of the duct walling. Nor are any special devices necessary to ensure that the duct walling lies correctly against a stop at the beginning of the working procedure, since the weight of the duct walling when inserted into the groove ensures a sufficient and correct compression force on the end edge of the duct walling in the groove.

The width of the groove is preferably greater than the thickness of the duct walling, and the side walls of the groove diverge towards the exterior, in order to ensure that bending at the flange edge of the duct walling is avoided.

Since there is particular stress on that portion of the die support which forms the pressure die, and the adjacent region, during edge folding, a further advantageous embodiment of the invention provides that the outer surface of that section of the die support which borders the side of the pressure die lying opposite the forming roller is formed of shaped blocks, which are displaceable along the die support parallel to its outer surface. Damaged or worn shaped blocks can be simply replaced by insertion of a new shaped block. Particular advantage can however be achieved by these shaped blocks, in that they can form small spaces between them, which serve for the reception of outwardly projecting folds or edges provided in the duct walling in certain circumstances. The shaped blocks in that case have simply to be arranged on the die support by displacement in such manner that a space between two adjacent shaped bodies is located wherever there is a fold or an edge, into which space the fold or edge can be inserted.

In a preferred embodiment the shaped bodies are displaceably mounted on the die support by means of a dovetail guide. Of course there are any number of other variants which permit easy sideways displacement of the shaped blocks on the die support.

The shaped bodies can form not only the outer surface of the die support facing the beam punch, but in an advantageous further development they can also form the side of the pressure die which lies opposite the forming roller. They then possess an approximately L-shaped cross section whereby the edge of the shaped body between the outer surface of the die support and the pressure die can be bevelled, thereby slowing down the swinging movement during the edge folding procedure, so that a violent 90° swing of the duct wall is avoided.

Since the beam punch especially is strongly stressed in carrying out the edge folding, it is desirable that it be exchangeably secured to the beam punch carrier, so that it can be replaced when worn.

The particularly heavy loaded parts of the apparatus, especially the shaped bodies, at least the part of the forming roller that forms one side of the pressure die, and at least the front section of the beam punch desirably consist of harder material than the other parts of the apparatus, with the exception of the bearing surface between the die support and the forming roller.

The beam punch carrier, in a first embodiment, is designed as a substantially rectangular frame, which carries on a longitudinal section of its interior the beam punch which faces the die support, and whose transverse sections are mounted on the die support, preferably on the rollers mentioned.

This frame-like embodiment of the beam punch carrier can be subjected to severe bending stresses when the sheet metal is of larger dimensions or when a thicker sheet metal is being worked. In a second preferred embodiment of the invention, therefore, the beam punch carrier is designed as a substantially cubic component housed for sliding displacement in an upwardly open recess of the die support, and the beam punch carrier bears hydraulic cylinders, whose pistons project on vertical end faces of the beam punch carrier facing in opposite directions, and (whose pistons) are supported on oppositely disposed vertical end walls of the recess. In this embodiment the beam punch carrier can be designed as a substantially compact component and, with the exception of the hydraulic cylinders a massive one, so that it is more resistant to bending (stress). The vertical section of the die support is substantially C-shaped in the region of the recess.

The hydraulic cylinders can be used as inserted parts in holes bored in the beam punch carrier or (advantageously) can be worked directly into the beam punch carrier.

A substantially larger force is necessary for carrying out the edge folding than for withdrawing the beam punch from the pressure mould. In a useful embodiment of the invention, therefore, a larger number of adjacent parallel hydraulic cylinders is provided for producing the folding motion of the beam punch carrier than for producing the return movement. For example, twelve strong hydraulic cylinders can be provided, arranged mutually adjacent in a row, to produce the folding movement, while three smaller hydraulic cylinders suffice for producing the return movement. By means of the multiplicity of hydraulic cylinders, the pressure force during the folding process is uniformly distributed over the length of the beam punch. Therefore hardly arises any bending stress.

BRIEF DESCRIPTION OF THE DRAWINGS

In all the figures the same reference numerals are used for the same or similar parts.

DESCRIPTION OF THE PREFERRED EMBODIMENT

Figure 1:
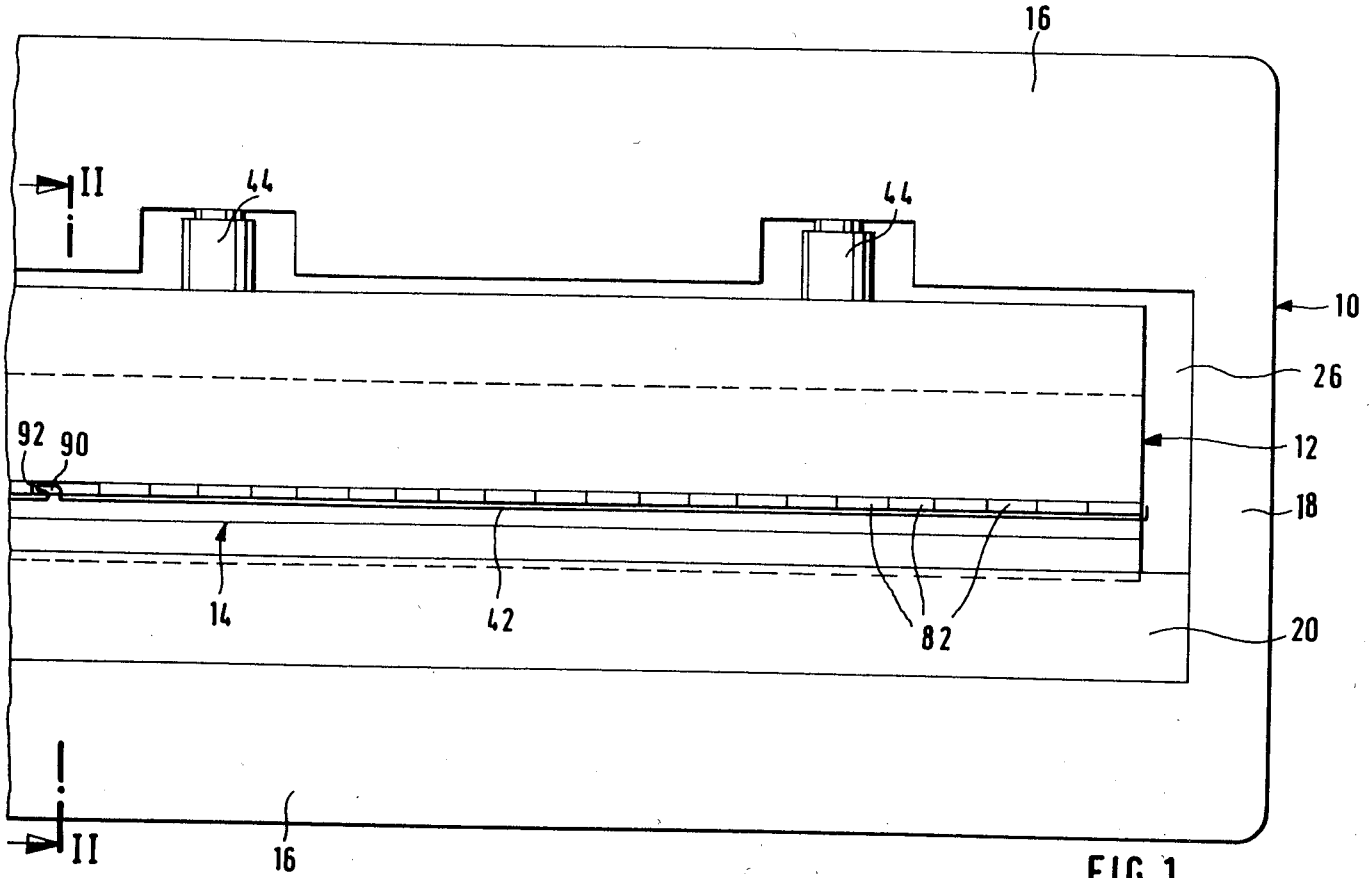
FIG. 1 is a schematic plan view of a first embodiment.
Figure 2:
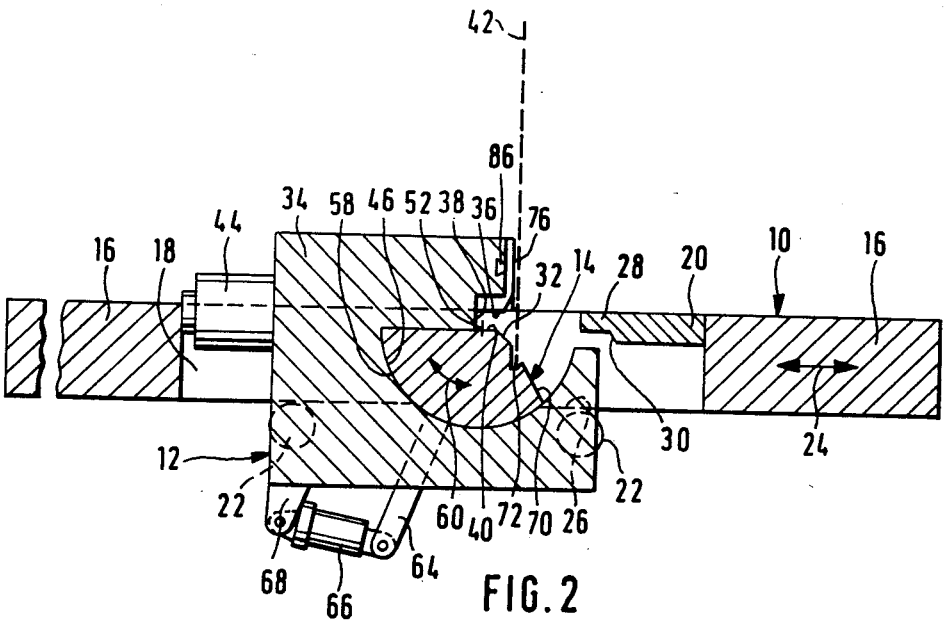
FIG. 2 is a schematic section along the line II—II in FIG. 1.
Figure 3:
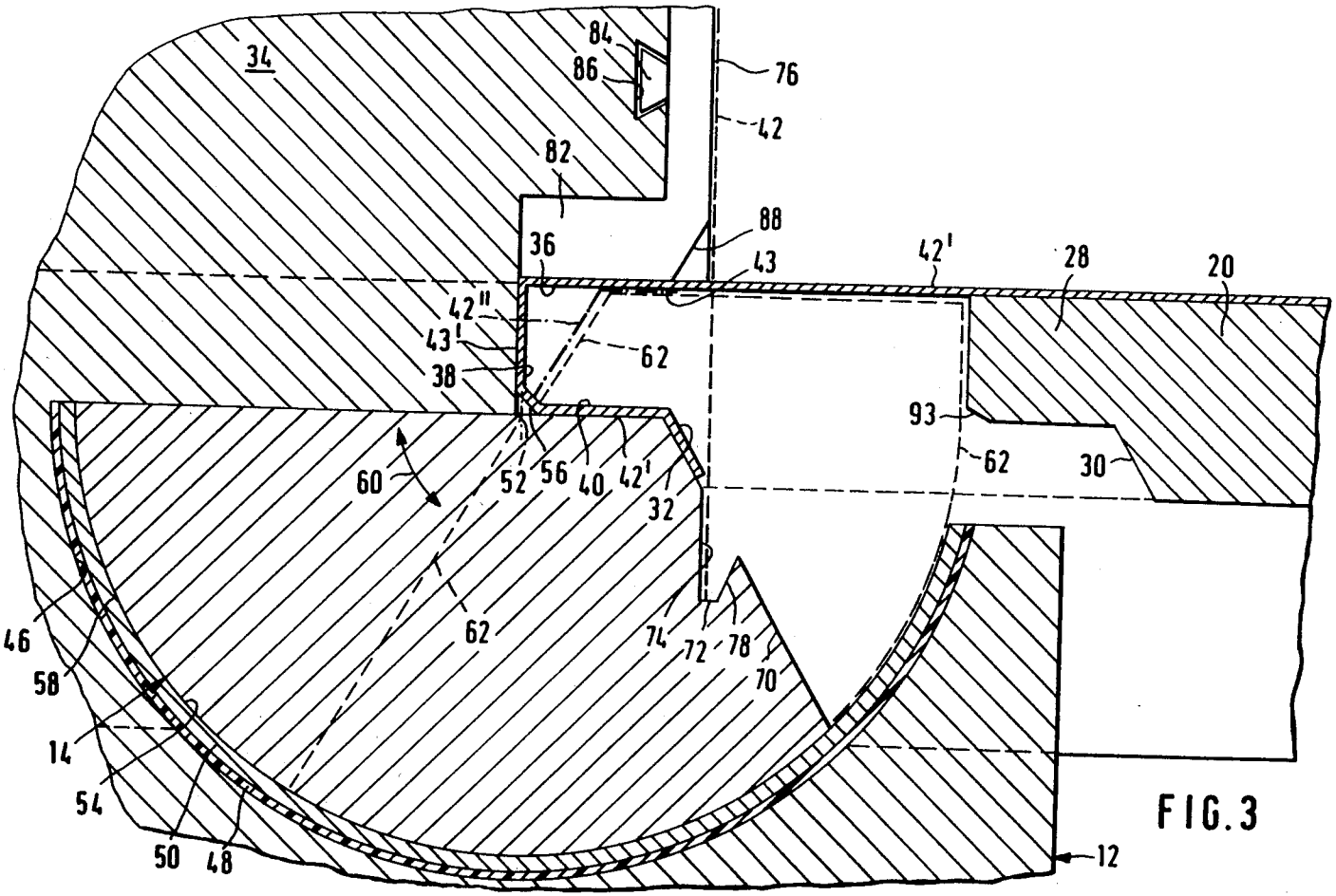
FIG. 3 is an enlarged detail from FIG. 2.

The embodiment of the invention illustrated in FIGS. 1 to 3 essentially shows three mutually moveable parts, namely a beam punch carrier 10, a die support 12, and a forming roller 14. The beam punch carrier 10 is designed substantially as a rectangular frame with two parallel longitudinal members 16 and two transverse members 18. The transverse members 18 are housed on a horizontal lower part 26 of the die support 12, for horizontal to and fro movement on rollers 22 in the direction of the double arrow 24, and for this purpose the rollers 22 are rotatably secured to the die support 12.

The inwardly facing beam punch 20 is arranged along the inner side of one longitudinal member 16 of the beam punch carrier 10, and its plate-like cross section is horizontally arranged in the upper region of the beam punch carrier 10. The cross section has a transverse rectangular front portion 28, and, on its lower side, a bevel 30 which is directed diagonally outward, and agrees with a corresponding bevel 32 on the pressure die which is further to be described below.

The die support 12, for its part, can be provided in any desired way with light feet for standing, or means for suspending it. These features are not illustrated, and they are required to support the weight of the device itself but not to withstand stresses from outside. This die support 12 comprises an upward extension 34 rising from its horizontal lower part 26 in the interior of the frame 16, 18 formed by the beam punch carrier 10. This extension 34 forms two sides 36 and 38 of a pressure die which faces the beam punch 20, the third side 40 thereof, including its adjacent outwardly directed bevel 32, being formed by the forming roller 14. The front section 28 of the beam punch 20 is fitted into the pressure die 36, 38, 40 with play, the play corresponding roughly to the thickness of the sheet metal of the duct walling 42 which is to be worked.

Between the rearward longitudinal member 16 of the beam punch carrier 10 and the extension upward 34 of the die support 12, is supported a pair of parallel hydraulic cylinders 44 which operate in tandem, and effect a to and fro movement of the beam punch carrier 10 as shown by the double arrow 24. The forces which arise in this manner are taken up on the one hand by the frame-like beam punch carrier 10 and on the other hand by the die support 12, and do not have to be transmitted to any other parts of the machine.

The die support 12 comprises a recess 46 of approximately semi-circular cross section traversing the length of the upward extension 34, into which recess an upwardly open bronze pipe section 50 is cast by means of a layer 48 of casting resin. The bronze pipe section 50 forms a support surface 54 for the forming roller 14, and its mid-axis 52 coincides with the pivotal axis of the forming roller 14 and with the lower edge of the pressure die which lies between the sides 38 and 40.

The forming roller 14 comprises a sliding surface 58 matching the support surface 54, making possible a sliding movement of the surface 58 along the support surface 54 in the sense of the double arrow 60 and around the mid-axis 52, through an angle of approximately 60°. The forming roller 14 is shown in one of its terminal pivotal positions in full outline, and in the other terminal pivotal position in broken outline 62.

The pivoting of the forming roller 14 takes place by means of levers 64 rigidly secured thereto, the outer end of each of said levers is connected to a respective hydraulic cylinder 66 and the hydraulic cylinders 66 for their part are articulated to a (lug) attachment 68 on the lower side of the die support 12. Actuation of the hydraulic cylinders 66, therefore, causes the rolling motion in the sense of the double arrow 60.

The right half of the forming roller 14, as shown in FIGS. 2 and 3, comprises a downward bevel 70 at 60° to the horizontal in the pivotal position shown in unbroken lines. The upper end of this bevel forms the above mentioned bevel 32 of the pressure die. Adjacent this bevel 32 there is let into the bevel 70 a groove 72, extending over the entire length of the forming roller 14. The side wall 74 of the groove 72 which faces the beam punch 20, is vertically disposed in the pivotal position of the forming roller 14 shown in full outline, and is co-planar with the outer surface 76 of the die support 12 which faces the beam punch 20. The oppositely disposed side surface 78 of the groove 72 runs diagonally outward, so that the two side surfaces 74 and 78 diverge. The width of the groove 72 is substantially greater than the sheet metal thickness of duct walling 42 to be processed, which walling, at the beginning of a working process, is disposed vertically on the bottom of the groove 72.

The outer surface 76 of the die support 12, and the upper side 36 of the pressure die, in the illustrated embodiment are formed from a series of approximately L-shaped blocks 82, each having on its rear a dovetail part 84, the latter being freely displaceable along the upward extension 34 in a correspondingly formed dovetail guide 86 in the upward extension 34 of the die support 12. Each shaped block is provided with a bevel 88 between the outer surface 76 and the upper side 36 of the pressure die.

The shaped blocks can be arranged, for example, in the manner shown in FIG. 1, so that wherever an outwardly projecting fold 90 of the duct walling 42 is located, there is a respective space 92 to receive the fold 90.

Of course the spaces 92 can always be brought to a desired position of the duct walling, where a fold is located. When a flange is being formed on the end of the canal walling, therefore, the folds are preserved and do not get squashed which would be very disadvantageous.

The beam punch 20 is removably (exchangeably) secured to the beam punch carrier 10 in a manner not illustrated.

The embodiment illustrated in FIGS. 1 to 3 works as follows: At first the beam punch 20 is located in the position shown in the drawings, externally of the pressure die 36, 38, 40, and the forming roller is located in the position shown in unbroken lines in FIGS. 2 and 3. In this position of the parts a duct wall 42 is placed in a vertical position with its lower edge in the groove 72 so that it abuts the side wall 74 of the groove 72 and the outer surface of the shaped blocks 82.

Next the hydraulic cylinders 44 are actuated uniformly so that the outer end 28 of the beam punch 20 is pressed into the pressure die 36, 38, 40, while the bevel 30 of the beam punch 20 is pressead against the bevel 32 on the forming roller 14. Thus the duct walling 42, which starts in a vertical position (shown in broken outline in FIG. 3) is pressed into the shape 42' shown in FIG. 3 in full outline. The lower end of the duct walling is pushed into the pressure die by the beam punch 20, as shown in FIG. 3, while the upper section of the duct walling 42 which is not drawn into the pressure die is swivelled around from its original vertical position during the edge folding, through an angle of 90° into a position lying on the upper side of the beam punch 20. The swivelling motion occurring on operation of the beam punch 20 takes place substantially by gravity and does not need to be specially guided so as to avoid bending or distortion of the duct walling.

A bevel 93 is provided on the lower edge of the forward part 28 of the beam punch 20, in order to achieve a more useful development of the workpiece sheet metal of the duct walling 42. This produces a bevelling 56 of the duct walling 42 during the edge folding operation.

Finally the beam punch 20 is withdrawn to the starting position as in FIGS. 2 and 3, and the hydraulic cylinders 66 are thereupon actuated whereby the forming roller 14 is pivoted as shown by the double arrow 60 from the position shown in full outline in FIGS. 2 and 3 into the position 62 shown in broken outline. By this means that section of the duct walling 42' which is lying on the side 40 and on the bevel 32 of the pressure die is turned into the position 42'' shown in dot and dash outline in FIG. 3, whereby the outermost section 43 of the formed flange comes to rest parallel to the undeformed section of the duct walling 42', and can be secured thereto in known manner, e.g. by spot welding. Then the forming roller 14 is pivoted back into the starting position shown in full outline. The duct walling 42' with the flange 43', 42'', 43 formed thereon can thereupon be removed from the apparatus.

The method of operating the apparatus is extraordinarly simple and free from faults, in fact lubrication between the supporting surface 54 and the sliding surface 58 is all that has to be done for operation.

Figure 4:
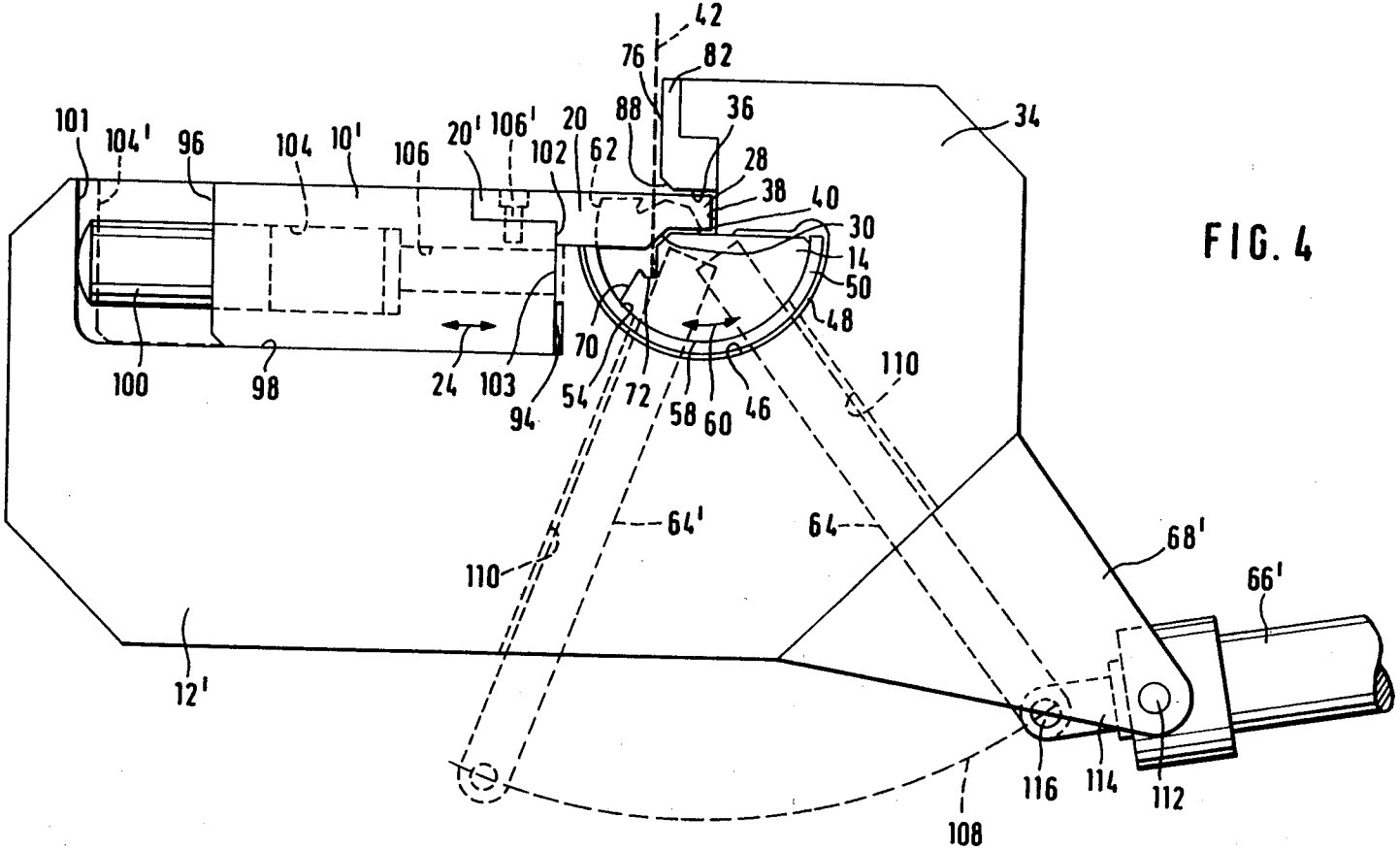
FIG. 4 is a schematic side view of a second embodiment viewed as from the right in FIG. 5
Figure 5:
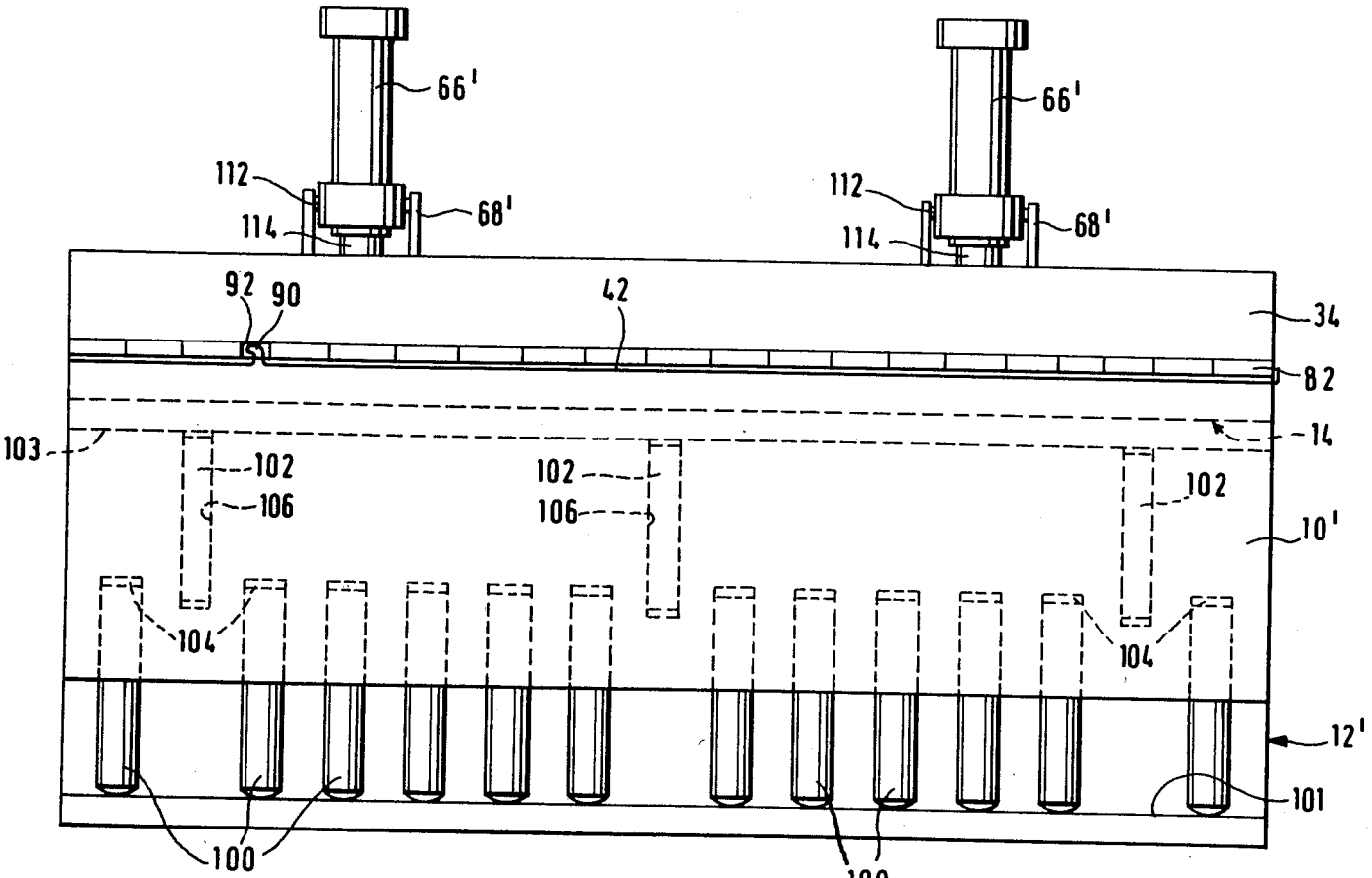
FIG. 5 is a schematic plan view of the embodiment illustrated in FIG. 4.

The second embodiment of the apparatus according to the invention illustrated in FIGS. 4 and 5 differs from the embodiment illustrated in FIGS. 1 to 3 mainly by the design of the die support 12' and the beam punch carrier 10'. The remaining parts of the apparatus, to the extent that they carry the same reference numerals as in FIGS. 1 to 3 function in the manner described above and are substantially identically designed.

In order to atain a greater stability of the beam punch carrier 10', the latter is designed as a compact, substantially cubic component with substantially vertical front end surface 94 and a substantially vertical rearward end surface 96. It is slidably movable to and fro in an upwardly open recess 98 of the die support 12' in the direction of the double arrow 24. The to and fro movement, in the illustrated embodiment, is effected by twelve closely spaced rearward hydraulic pistons 100, which project from the rearward end surface 96 and are supported on an oppositely disposed vertical wall 101 of the recess 98, and by three rearward (sic) hydraulic pistons 102 spaced apart between them, the latter rams projecting from the rearward end surface 94 and being supported on an oppositely disposed wall 103 of the recess 98. The substantially stronger rearward hydraulic pistons 100 are received in corresponding hydraulic cylinders 104 in the interior of the beam punch carrier 10', while the weaker, forward hydraulic rams 102 are received in corresponding hydraulic cylinders 106 in the interior of the beam punch carrier 10'. By alternate actuation of the hydraulic cylinders 100 and 102 the beam punch carrier 10' is moved to and fro between the position shown in full outline in FIG. 4 and the position 104' shown in broken outline. The beam punch 20 is removably secured by its rearward end 20' to the beam punch carrier 10' by means of screws 106', and can thus be easily exchanged when worn.

In this embodiment also, the pivoting of the forming roller 14 takes place by means of levers 64 rigidly attached thereto, which can be swung along the broken line 108 in FIG. 4 into the position 64', likewise shown in broken outline, and back again, by actuation of the hydraulic cylinders 66'. The levers 64 move in slot-like apertures 110 of the die support 12'. The hydraulic cylinders 66' are connected to (lug) attachments 68' by pivot mountings 112, the attachments 68' being rigidly attached to the die support 12'. The outer ends of the hydraulic rams 114 received in the hydraulic cylinders 66' are connected with the outer ends of the levers 64 by pivotal joints 116.

The embodiment illustrated in FIGS. 4 and 5 is suitable for the application of substantially greater forces on the duct walling 42 to be processed since the beam punch carrier 10' in particular is designed to be substantially more compact and thus more hard wearing than in the embodiment previously described. Since substantially smaller forces are necessary for the return movement of the beam punch carrier after the edge folding operation, this explains the choice of a larger number of strong rearward hydraulic cylinders and a smaller number of weaker hydraulic cylinders. This embodiment is considerably simpler and involves smaller manufacturing costs than the installation of a larger number of strong double acting hydraulic cylinders.

I claim:

1. Apparatus for flanging the walls of ventilation ducts of sheet metal by successive edge folding and roll forming, with at least three parts mutually displaceable by hydraulic drive, of which a first part comprises a forming roller, the second part comprises a die support which contains a pressure die and the third part comprises a beam punch carrier which carries a beam punch which can be pressed against the pressure die, that the die support and the beam punch carrier are housed for low-friction mutual horizontal displacement, that a first hydraulic drive is supported between the die support and the beam punch carrier, that the forming roller is pivotably housed in the die support and that a second hydraulic drive is supported between the die support and the forming roller the improvement comprised of an outwardly directed bevel in cross section positioned on a side of the pressure die formed by the forming roller, said bevel matching a corresponding bevel positioned on the beam punch so that said beam punch and forming roller cooperate to deform the sheet metal therebetween.

2. Apparatus according to claim 1, characterized in that the beam punch carrier is housed for horizontal displacement on rollers located in the die support.

3. Apparatus according to claim 1 characterized in that the pressure die is partly formed from the forming roller.

4. Apparatus according to claim 3 characterized in that the die support forms two sides of the pressure die which has a substantially rectangular cross section, and the forming roller forms the third side.

5. Apparatus for flanging the walls of ventilation ducts of sheet metal by successive edge folding and roll forming, characterized in that at least three parts are mutually displaceable by hydraulic drive, of which a first part comprises a forming roller, the second part comprises a die support which contains a pressure die and the third part comprises a beam punch carrier which carries a beam punch whereby said beam punch can be pressed against the pressure die; said die support and the beam punch carrier being housed for low-friction mutual horizontal displacement on rollers located in the said die support; and the forming roller being pivotably housed in the die support; the apparatus being further characterized by a first hydraulic drive supported between the die support and the beam punch carrier; a second hydraulic drive supported between the die support and the forming roller whereby the die support forms two sides of the die pressure which has a substantially rectangular cross section, and a third side of the pressure die is formed by the forming roller having an outwardly directed bevel in cross section, which matches a corresponding bevel on the beam punch so that said beam punch and forming roller cooperate to deform the sheet metal therebetween.

6. Apparatus for flanging the walls of ventilation ducts of sheet metal by successive edge folding and roll forming, characterized in that at least three parts are mutually displaceable by hydraulic drive, of which a first part comprises a forming roller, the second part comprises a die support which contains a pressure die and the third part comprises a beam punch carrier which carries a beam punch whereby said beam punch can be pressed against the pressure die; said die support and the beam punch carrier being housed for low-friction mutual horizontal displacement the forming roller being pivotably housed in a bearing surface of the die support having an arcuate cross section, for pivoting about the mid-axis of the bearing surface with a sliding surface adapted to the bearing surface; a first hydraulic drive supported between the die support and the beam punch carrier and a second hydraulic drive being supported between the die support and the forming roller.

7. Apparatus according to claim 6, characterized in that the mid-axis of the bearing surface approximately coincides with one edge of the pressure die.

8. Apparatus according to claim 7, characterized in that that edge of the beam punch which co-operates with the one edge of the pressure die possesses a bevel.

9. Apparatus according to claim 6, characterized in that the bearing surface is formed from a pipe section of bronze whose cross section corresponds to an arc of a circle.

10. Apparatus according to claim 9, characterized in that a space between the bronze pipe section and recess of the die support is poured full of casting resin.

11. Apparatus according to claim 6, characterized in that the forming roller has a groove for reception of the vertically standing duct wall before the edge folding, said groove having a vertical side wall positioned facing the beam punch, whereby in the corresponding roll position of the forming roller is flush with the beam punch-facing vertical outer surface of that section of the supporting part which borders on the side of the pressure die lying opposite the forming roller.

12. Apparatus according to claim 11, characterized in that the width of the groove is greater than the thickness of the duct wall, and that the side walls of the groove diverge outwardly.

13. Apparatus for flanging the walls of ventilation ducts of sheet metal by successive edge folding and roll forming, characterized in that at least three parts are mutually displaceable by hydraulic drive, of which a first part comprises a forming roller, the second part comprises a die support which contains a pressure die and the third part comprises a beam punch carrier which carries a beam punch whereby said beam punch can be pressed against the pressure die, said die support and the beam punch carrier being housed for low-friction mutual horizontal displacement and the forming roller being pivotably housed in the die support; a first hydraulic drive supported between the die support and the beam punch carrier and a second hydraulic drive supported between the die support and the forming roller; said die support further having an outer surface support on that section which borders on the side of the pressure die lying opposite the forming roller said support being formed of shaped blocks which are displaceable along the die support parallel to the outer surface.

14. Apparatus according to claim 13, characterized in that the shaped blocks are displaceably housed on the die support by means of a dovetail guide.

15. Apparatus according to claim 13, characterized in that the shaped blocks form that side of the pressure die which lies opposite the forming roller.

16. Apparatus according to claim 15, characterized in that the edge of the shaped blocks which lies between the outer surface of the die support and the pressure die are bevelled.

17. Apparatus according to claim 13, characterized in that the shaped blocks, of that part of the forming roller which forms a side of the pressure die which lies opposite the forming roller and the front section of the beam punch consist of harder material than the remaining parts of the apparatus with the exception of the support surface.

18. Apparatus for flanging the walls of ventilation ducts of sheet metal by successive edge folding and roll forming, characterized in that at least three parts are mutually displaceable by hydraulic drive, of which a first part comprises a forming roller, the second part comprises a die support which contains a pressure die and the third part comprises a beam punch carrier, a beam punch is replaceably secured to said beam punch carrier which carries said beam punch whereby said beam punch can be pressed against the pressure die; said die support and the beam punch carrier being housed for low-friction mutual horizontal displacement, the forming roller being pivotably housed in the die support; a first hydraulic drive supported between the die support and the beam punch carrier; and a second hydraulic drive supported between the die support and the forming roller.

19. Apparatus for flanging the walls of ventilation ducts of sheet metal by successive edge folding and roll forming, characterized in that at least three parts are mutually displaceable by hydraulic drive, of which a first part comprises a forming roller, the second part comprises a die support which contains a pressure die and the third part comprises a beam punch carrier, said beam punch carrier being a substantially rectangular frame comprised of two parallel longitudinal members and two transverse members, which carries the beam punch inside on one longitudinal section and whose transverse members are housed on the die support whereby said beam punch can be pressed against the pressure die; said the die support and the beam punch carrier being housed for low-friction mutual horizontal displacement, the forming roller being pivotably housed in the die support; a first hydraulic drive supported between the die support and the beam punch carrier, and a second hydraulic drive supported between the die support and the forming roller.

20. Apparatus for flanging the walls of ventilation ducts of sheet metal by successive edge folding and roll forming, characterized in that at least three parts are mutually displaceable by hydraulic drive, of which a first part comprises a forming roller, the second part comprises a die support which contains a pressure die and the third part comprises a beam punch carrier, said beam punch carrier is designed as a substantially cubic component smoothly and slideably housed in a recess of the die support which is upwardly open, whereby the beam punch carrier carries a plurality of hydraulic cylinders, each having pistons projecting from vertical end faces of the beam punch carrier which face in opposite directions, and are supported on oppositely disposed vertical end walls of the recess whereby said beam punch carrier carries a beam punch which can be pressed against the pressure die; said the die support and the beam punch carrier being housed for low-friction mutual horizontal displacement, the forming roller being pivotably housed in the die support; a first hydraulic drive supported between the die support and the beam punch carrier, and a second hydraulic drive supported between the die support and the forming roller.

21. Apparatus according to claim 20, characterized in that the hydraulic cylinders are recessed into the beam punch carrier.

22. Apparatus according to claim 20, characterized in that a larger number of adjacent parallel hydraulic cylinders is provided for producing the edge folding motion of the beam punch carrier than for producing the return movement thereof.

* * * * *